US006516492B1

(12) United States Patent
Kang

(10) Patent No.: US 6,516,492 B1
(45) Date of Patent: Feb. 11, 2003

(54) CENTRAL VACUUM CLEANING SYSTEM

(75) Inventor: Heung-Mook Kang, Seoul (KR)

(73) Assignee: Nam & Nam, Seoul (KR)

( * ) Notice: Subject to any disclaimer, the term of this patent is extended or adjusted under 35 U.S.C. 154(b) by 0 days.

(21) Appl. No.: 09/744,311

(22) PCT Filed: Jul. 22, 1998

(86) PCT No.: PCT/KR98/00222

§ 371 (c)(1),
(2), (4) Date: Jan. 19, 2001

(87) PCT Pub. No.: WO00/04814

PCT Pub. Date: Feb. 3, 2000

(51) Int. Cl.[7] ..... A47L 9/12
(52) U.S. Cl. ..... 15/314; 15/347
(58) Field of Search ..... 15/314, 347, 350, 15/352, 415.1, 402

(56) References Cited

U.S. PATENT DOCUMENTS

| | | | | |
|---|---|---|---|---|
| 944,779 | A | * | 12/1900 | Fogarty |
| 2,467,652 | A | * | 4/1949 | Beede |
| 3,267,650 | A | * | 8/1966 | Lundin |
| 3,357,039 | A | | 12/1967 | Electrolux |
| 4,257,789 | A | * | 3/1981 | Leinfelt |
| 5,001,807 | A | * | 3/1991 | Arai |
| 5,664,285 | A | * | 9/1997 | Melito et al. |

FOREIGN PATENT DOCUMENTS

| | | | |
|---|---|---|---|
| DE | 3443526 | | 6/1986 |
| GB | 1443494 | | 7/1996 |
| JP | 5-23267 | * | 2/1993 |
| JP | 6-292642 | * | 10/1994 |
| JP | 2001-137159 | * | 5/2001 |
| WO | WO8704912 | | 8/1987 |

* cited by examiner

*Primary Examiner*—Terrence R. Till
(74) *Attorney, Agent, or Firm*—McDonnell Boehnen Hulbert & Berghoff

(57) ABSTRACT

A central vacuum cleaning system has a tube having a nozzle at an inlet of the tube for sucking air containing dust, a filter carrier connected with an outlet of the tube by an inlet of the filter carrier for filtering the sucked air, an intake hose connecting with an outlet of the filter carrier by an inlet of the intake hose for serving as a passage of the filtered air, an air intake box installed at a place to be cleaned and an outlet of the intake hose detachably connected with the air intake box, and a machine unit having a motor for forcedly sucking air through the air intake box. The inet of the intake hose is swivelly connected with the filter carrier.

10 Claims, 8 Drawing Sheets

CENTRAL VACUUM CLEANING SYSTEM

TECHNICAL FIELD

The present invention relates to a central vacuum cleaning system, particularly to a central vacuum cleaning system having a filter carrier connected with a tube of a cleaning brush by an intake hose.

BACKGROUND ART

In general, a central vacuum cleaning system consists of a power generating part 200, a dust collecting part 300, pipes 400, a linker 500, connecting hose 600, and a cleaning unit as shown in FIG. 8.

The cleaning unit sucks air containing dust in a room, and the intaken dust flows toward the linker 500 through the connecting hose 600. The linker is installed at a predetermined position (for example, a wall) at a place to be cleaned. The dust flowing toward the linker 500 goes through the pipes 400 toward the power generating part 200 and the dust collecting part 300, wherein the power generating part 200 is integrally formed with the dust collecting part 300. The power generating part 200 receives electric power and generates a suction force caused by the rotation of a motor (not shown), and the dust collecting part 300 having a filter filters the collected matters from the intake air containing dust.

In the central vacuum cleaning system, as the refuse intaken with the air containing dust in the cleaning unit 700 is sucked through the connecting hose 500 and pipes 400 and is filtered at the filter in the dust collecting part 300, the central vacuum cleaning system has a problem. After prolonged, the collected matters accumulate at the curved portion of the pipes 400, and thus the pipes become clogged.

As the dust collecting part 300 is integral with the power generating part 200, the radius of the pipes 400 and the connecting hose 600 must be long for sucking the air containing dust.

Also, as the cleaning unit 700 is directly connected to the connecting hose 600, during the cleaning the weight of the connecting hose 600 is a burden upon the user.

DISCLOSURE OF INVENTION

Therefore, it is a first object of the present invention, for the purpose of solving the above mentioned problems, to provide a central vacuum cleaning system.

A second object of the present invention is to provide a central vacuum cleaning system preventing the pipes from accumulating the collected matter.

A third object of the present invention is to provide a central vacuum cleaning system having the pipes and the connecting hose having a small radius.

A fourth object of the present invention is to provide a central vacuum cleaning system which allows easy cleaning by the user.

BEST MODE FOR CARRYING OUT THE INVENTION

The preferred embodiment of the present invention will hereinafter be described in detail with reference to the accompanying drawings.

Figure 1:
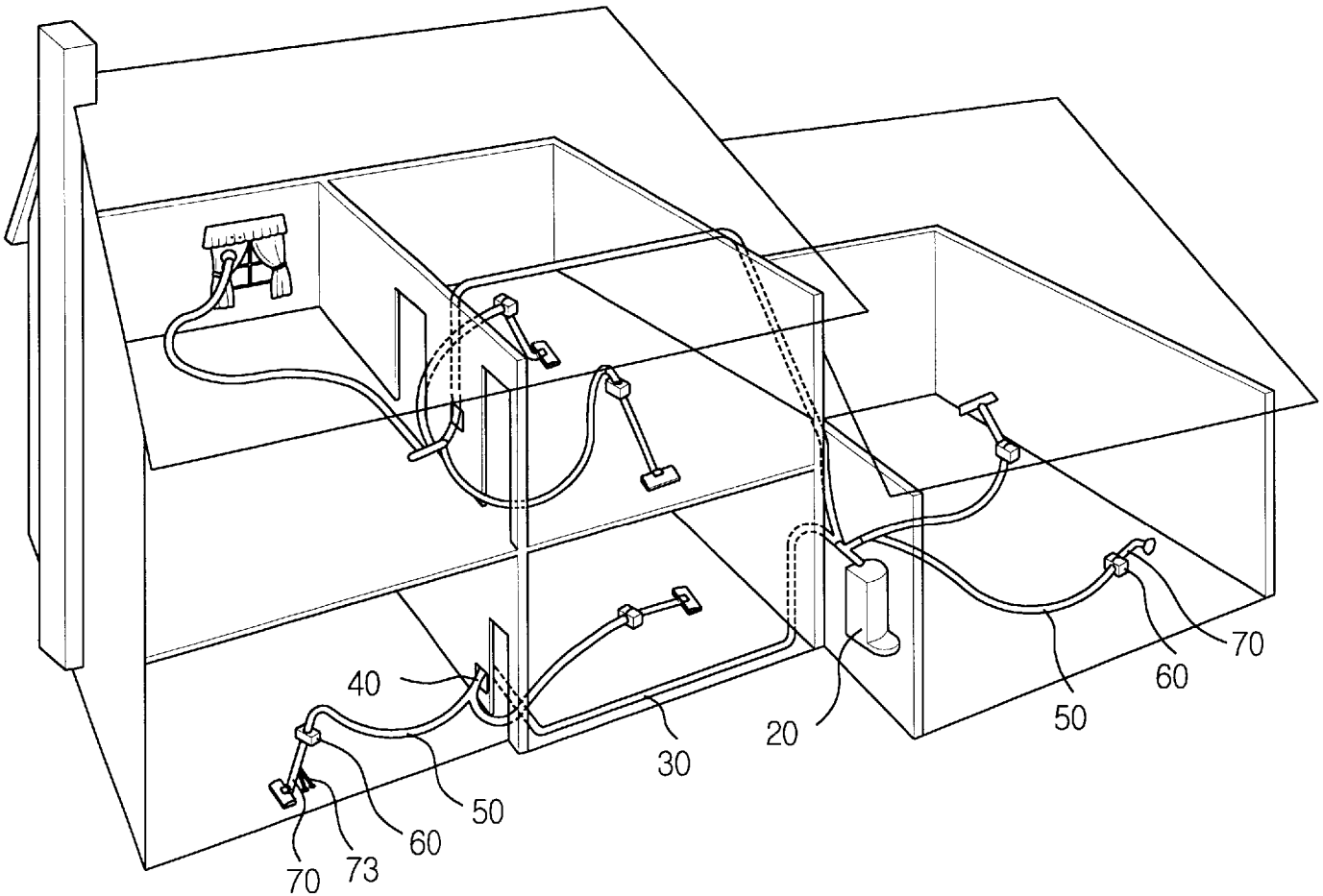
FIG. 1 shows a using condition of a central vacuum cleaning system according to the present invention.

A central vacuum cleaning system according to the present invention is shown in FIG. 1. The central vacuum cleaning system has a tube 70 for sucking air containing dust, a filter carrier 60 for filtering the air intake through the filter carrier 60, an intake hose 50 for flowing the filtered air through the filter carrier 60 to an air intake box 40, and a machine unit 20 for forcedly sucking air collected at the intake hose 50 through the pipes 30.

Figure 2:
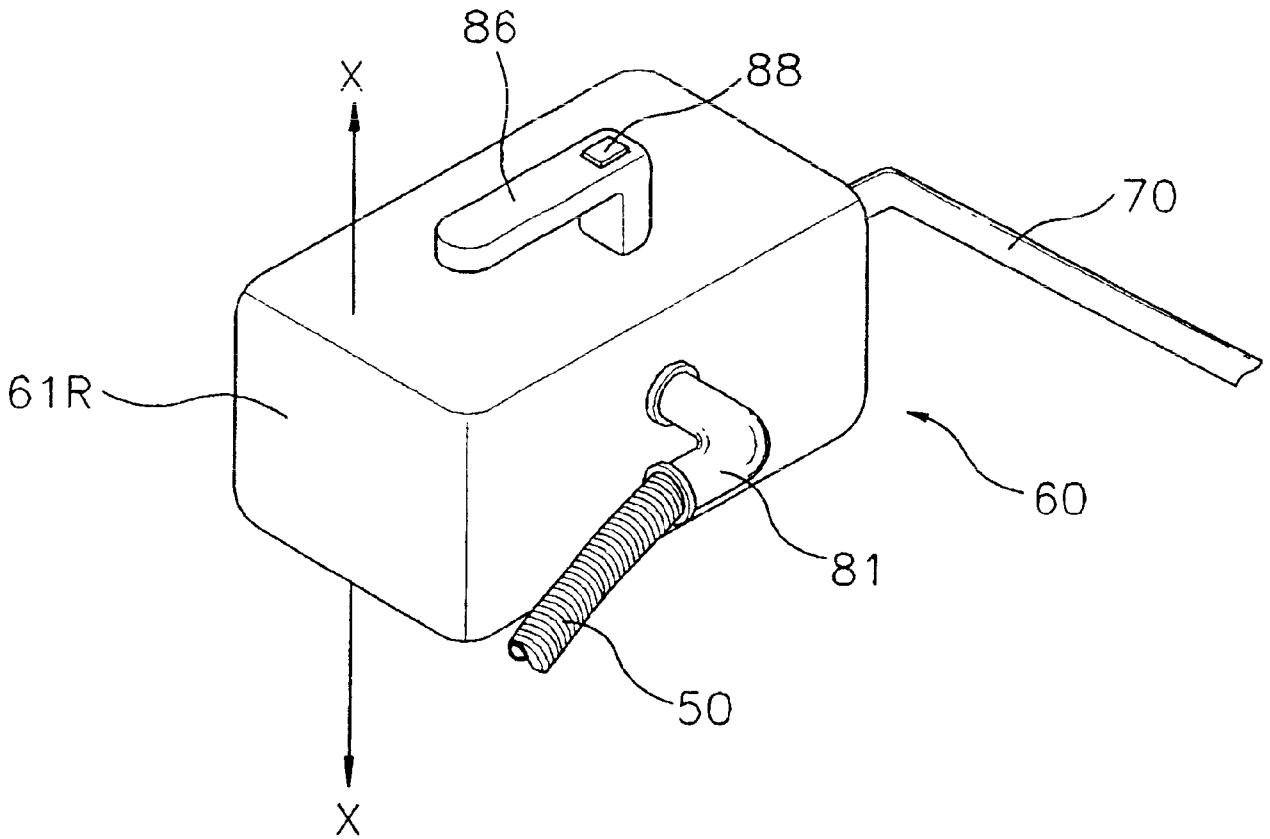
FIG. 2 is an enlarged exploded view of an embodiment of a filter carrier of a central vacuum cleaning system according to the present invention.
Figure 3:
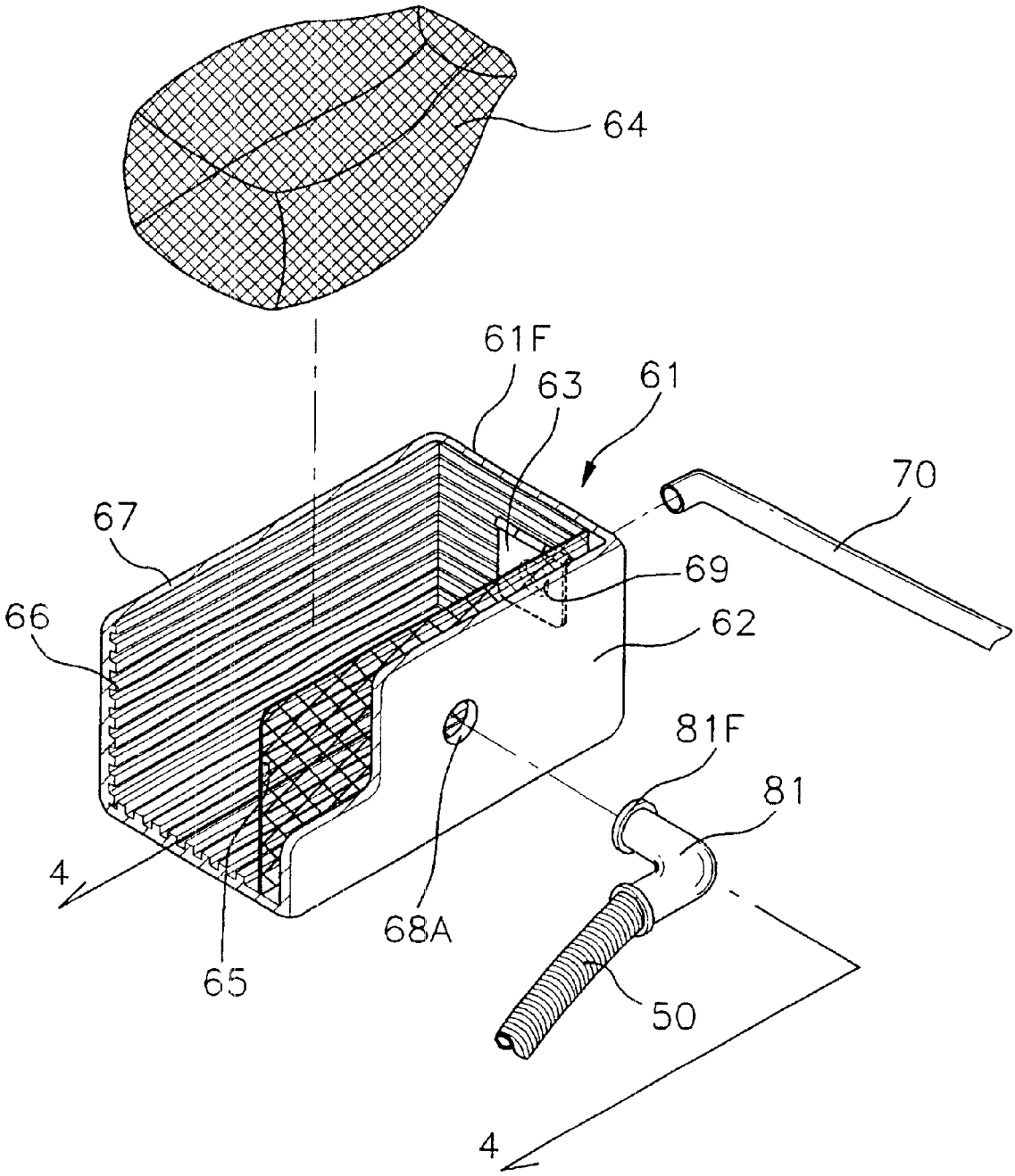
FIG. 3 is a partially cut-away perspective view of the filter carrier shown in FIG. 2.

The filter carrier 60, as shown in FIGS. 2 and 3, has a hook 86 for easily moving the filter carrier 60 under the condition that the tube 70 and the intake hose 60 are connected to the filter carrier 60, and a switch member 88 connected with the electric power for actuating a motor (not shown) of the machine unit 20 is installed at the hook 86. Further, the filter carrier 60 has a housing 61 and a filter 64 detachably provided in the housing 61. The housing 61 has an intake inlet 69 formed at a front face 61F of the housing 61 for sucking air containing dust through the tube 70 inward to the housing 61 and an outlet 68A formed at right plate 62 for providing dust-filtered air from the intaken air.

A flap valve 63 is hinged inside the housing 61 forming the intake inlet 69 thereon. Also, a net 65 is provided inside the housing 61 at a predetermined distance from the right plate 62 having the outlet 68A. A plurality of grooves 66 are provided at each inner face of the housing 61 except the right plate 62 for guiding the air when the filter 64 is directly contacted to each plate of the housing 61 during the suction process.

Figure 4:
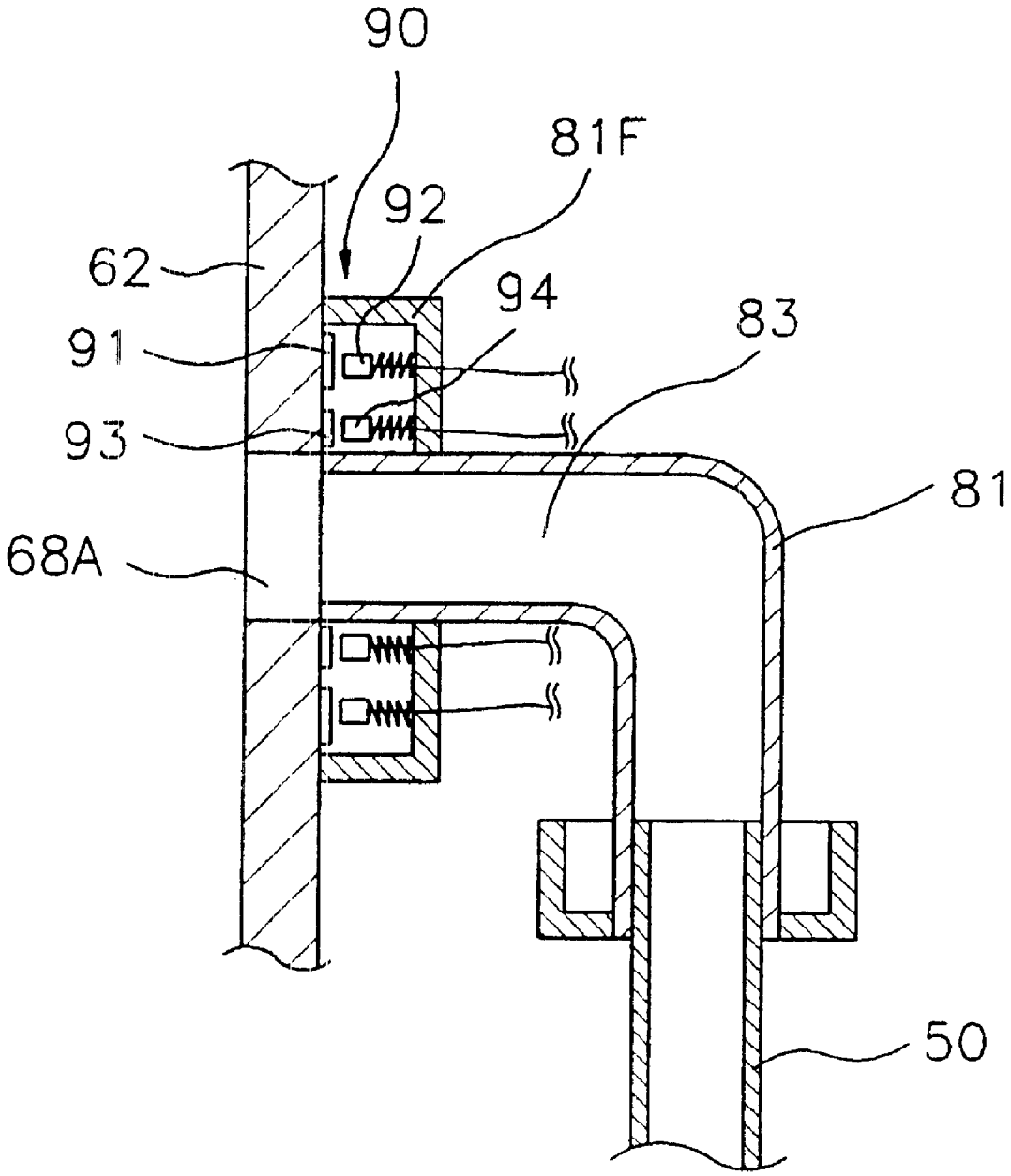
FIG. 4 is a section view showing along line 4—4 in FIG. 3.

An elbow 81 is installed between the intake hose 50 and the outlet 68A of the right plate 61 for swivel contacting the intake hose 50 with the right plate 62 of the filter carrier 60. As shown in FIG. 4, a swivel contact is provided at a swivel connecting portion 90 at which the elbow 81 is connected to the right plate 62 of the filter carrier 60. The swivel connecting portion 90 has an inner ring 93, an outer ring 91, an inner contact portion 94, and an outer contact portion 92. The inner and outer rings 93, 91 are made of copper and are provided around the outlet 68A. The inner and outer contact portions 94, 92 are formed at the front end of the elbow 81 and are contacted to each of the inner and outer rings 93, 91. Each of the inner and outer rings 93, 91 is connected to the switch member 88 of the hook 86 by electric wire (not shown). The inner and outer contact portions 94, 92 are connected to the motor (unshown) of the machine unit 20.

On the other hand, the left plate 67 is symmetrically arranged to the right plate 62.

Figure 5:
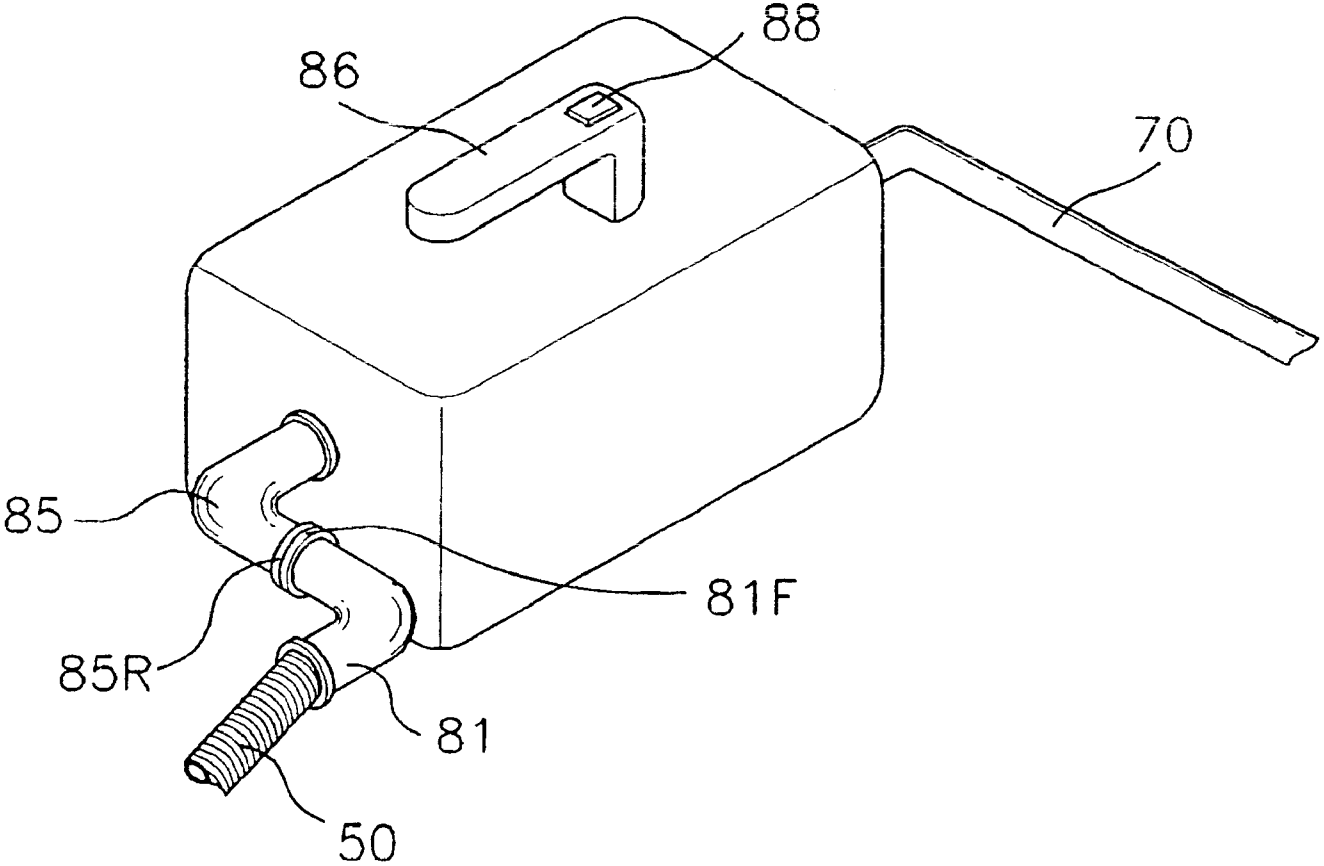
FIG. 5 is an enlarged perspective view of another embodiment of the filter carrier as shown in FIG. 2.

FIG. 5 shows another embodiment of the filter carrier 60, in which the intake hose 50 is connected to the rear portion 61R of the filter carrier 60. In this embodiment, after the outlet 68A of the housing 61 is connected to the other elbow 85, the elbow 81 is connected to the elbow 85. At this time an electric contacting portion is provided at the elbow 85 for driving the motor (not shown) of the machine unit 20 by the operation of the switch member 88. That is, the inner contact portion 94 and the outer contact portion 92, as previously described in the first embodiment of the present invention, are provided at the front portion 85F of the elbow 85 connected to the outlet 68A. On the other hand, the inner ring 93 and the outer ring 91 are provided at the rear portion 85R connected to the elbow 85.

The operation of the central vacuum cleaning system as described above will be described below.

When the user turns on the switch member 88 formed at the filter carrier 60, the motor (not shown) of the machine unit 20 operates. The filter carrier 60 receives air containing dust through the tube 70 caused by the suction force of the motor. At that time, the flat valve 63 in the filter carrier 60 opens, so air containing dust flows in the filter 64. Dust-filtered air exhausts to the outside of the filter 64 and flows toward the outlet 68 along a number of grooves 66 in the housing 61. During the intake process, the filter 64 distends, but the net 65 is installed adjacently with the outlet 68 controls to distend the filter 64, that is, the net 65 prevents the outlet 68 from being filled up by the filter 64.

When the user grasps the hook 86 of the filter carrier 60 and moves forward and backward for cleaning the place to be cleaned, the user does not bear the weight of the intake hose 50 because the intake hose 50 swivelly connected to the right place 62 freely rotates. The swivel contact portion 90 prevents the cleaning system from breaking the electric power when the intake hose 50 is rotated, that is, the electric power can be provided to the cleaning system when in use.

Figure 6:
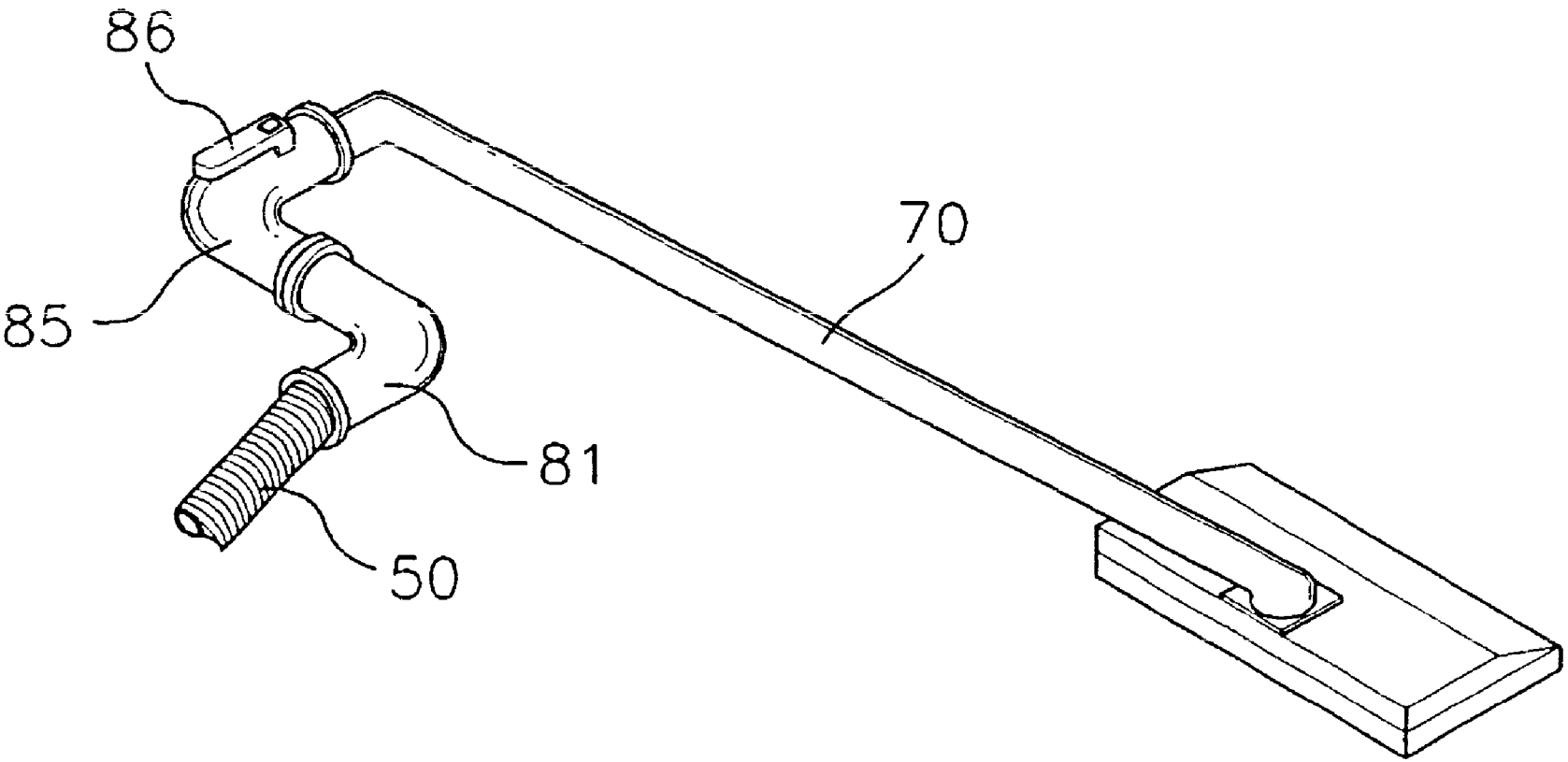
FIG. 6 is a perspective view of a condition that an intake hose is connected to a tube through an elbow.

FIG. 6 shows the following condition that the filter carrier 60 is removed. The tube 70 is connected to the elbow 85, the other end of the elbow 85 is connected to the elbow 81, and the other end of the elbow 81 is connected to the intake hose 50. This connecting condition is provided for only sucked air containing dust when the place to be cleaned is filled with the foul air.

Figure 7:
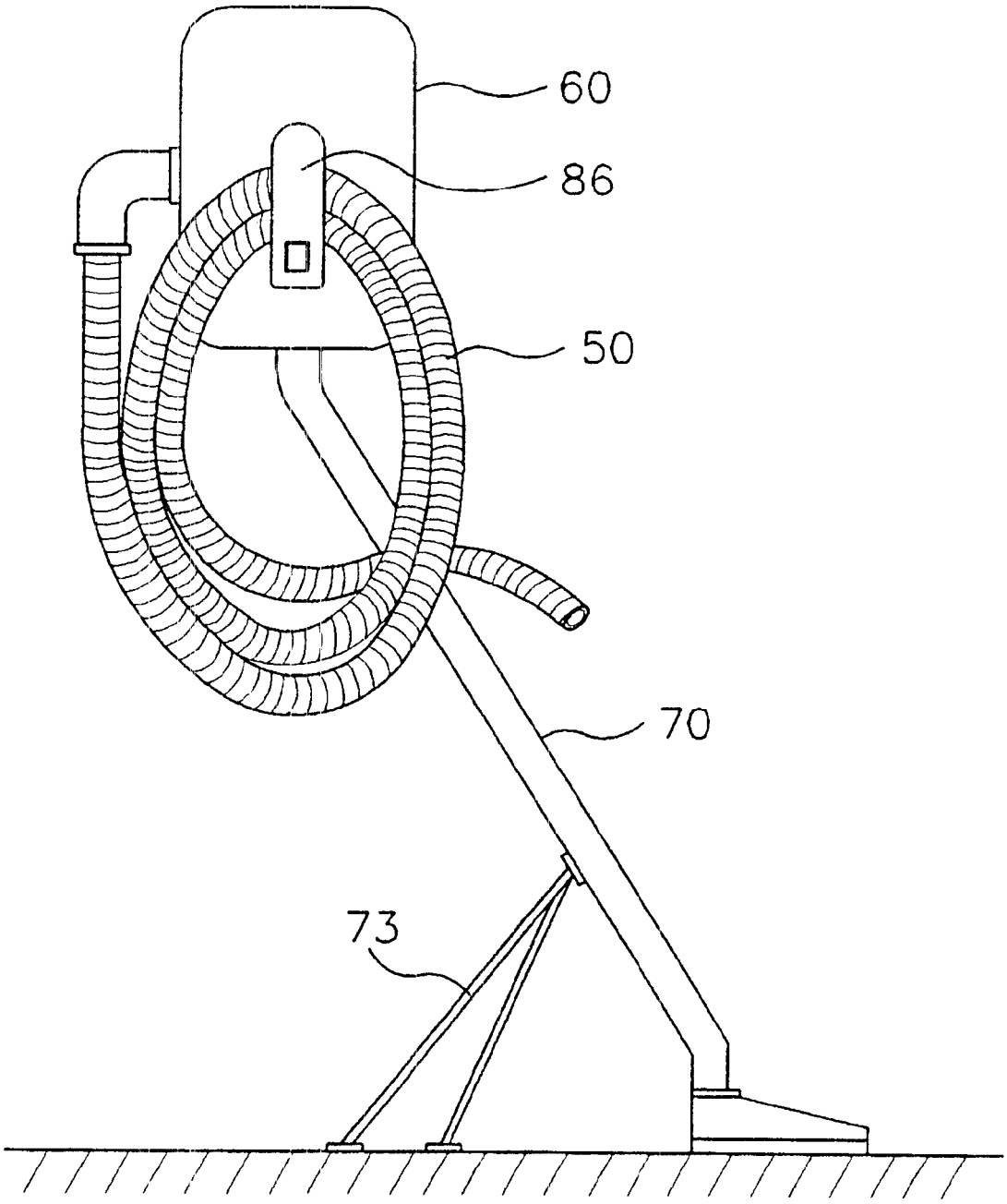
FIG. 7 shows a condition of the tube and filter carrier when not in use.
Figure 8:
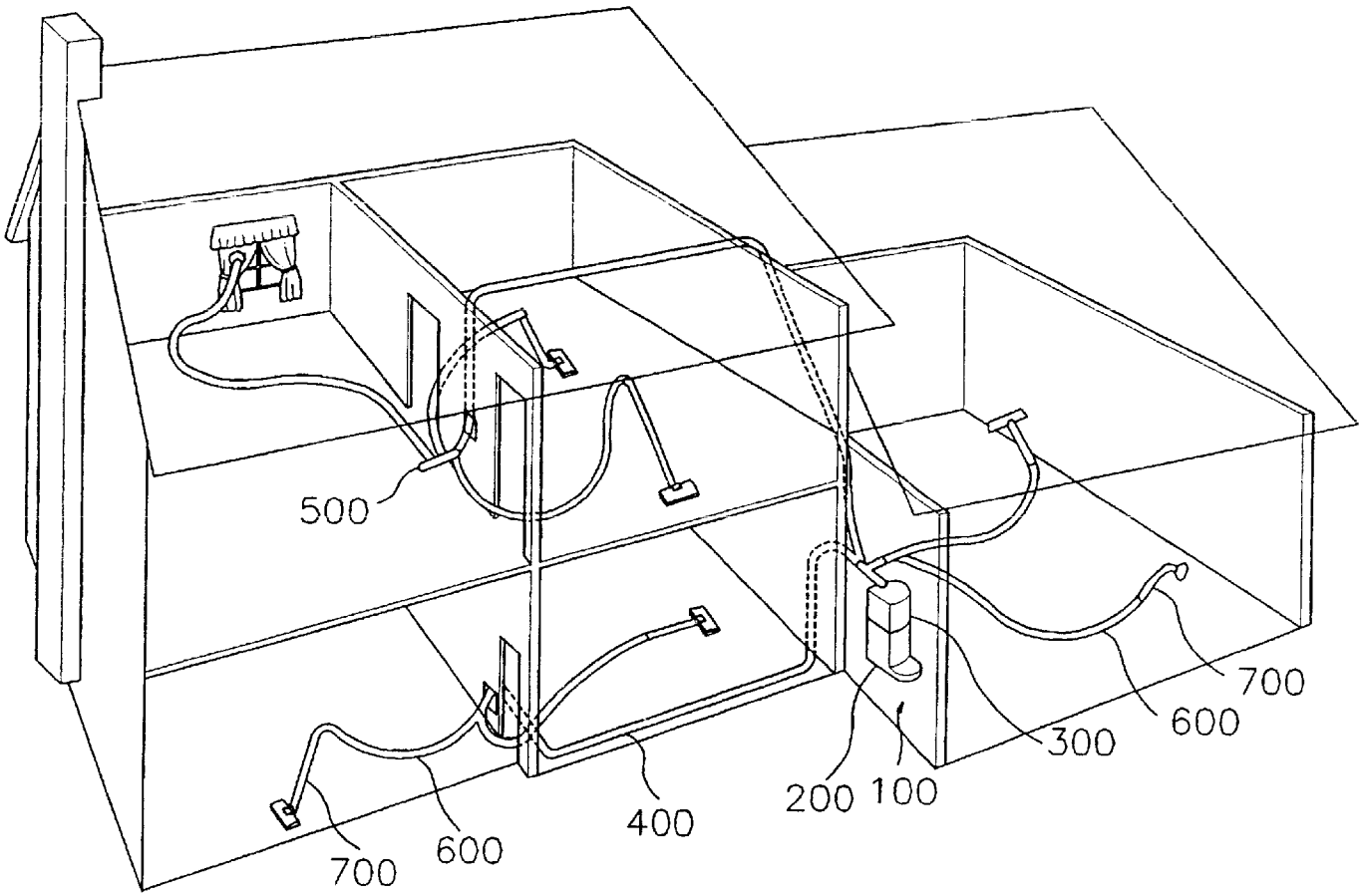
FIG.8 PRIOR ART
FIG. 8 shows a using condition of the conventional central vacuum cleaning system.

After the cleaning process, the user detaches the intake hose 50 from the intake box 40 as shown in FIG. 7, and holds the rolled up intake hose 50 on the hook 86 of the filter carrier 60, and the tube 70 is safely supported by the backer 73.

According to the present invention, since the filter is installed between the tube and the intake hose, dust is filtered by the filter, so air without dust flows to the machine unit through the intake hose. Therefore, the present invention prevents the intake hose from being filled up by the collected dust.

Also, since only air without dust flows through the intake hose, the radius of the intake hose can be small, and the user can clean the place to be cleaned without inconvenience because the intake hose is swivelly connected to the filter carrier.

While the invention has been described with reference to specific embodiments, the description is illustrated and is not to be constructed as limiting the scope of the invention. Various modifications and changes may occur to those skilled in the art without departing from the spirit and scope of the invention as defined by the appended claims.

What is claimed is:

1. A central vacuum cleaning system comprising:

a tube having a nozzle at an inlet of the tube for sucking air containing dust;

a filter carrier connected with an outlet of the tube by an inlet of the filter carrier for filtering the sucked air, the filter carrier having a filter detachably provided in a housing of the filter carrier, and a switch member for actuating the motor;

an intake hose connecting with an outlet of the filter carrier by an inlet of the intake hose for serving as a passage of the filtered air;

an air intake box installed at a place to be cleaned and an outlet of the intake hose detachably connected with the air intake box;

a machine unit having a motor for forcedly sucking air through the air intake box;

a net in the filter carrier adjacent to the inlet of the intake hose;

a plurality of grooves in the housing of the filter carrier where the filter is contacted; and a backer at the tube for supporting the tube when not in use.

2. The central vacuum cleaning system according to claim 1, wherein the inlet of the intake hose is swivelly connected with a first plate of the housing, the first plate is provided at a location perpendicular to a direction of an air flow running along the tube.

3. The central vacuum cleaning system according to claim 2, wherein the inlet of the intake hose is shaped as an elbow.

4. The central vacuum cleaning system according to claim 2, wherein a swivel contact is provided at the swivel connecting portion and connects an electric wire leading from the air intake box with the switch member of the filter carrier.

5. The central vacuum cleaning system according to claim 1, wherein the inlet of the intake hose is swivelly connected with a rear portion of the housing, the rear portion is provided at a direction parallel to an air flow running along the tube.

6. The central vacuum cleaning system according to claim 5, wherein the inlet of the intake hose is shaped as an elbow.

7. The central vacuum cleaning system according to claim 5, wherein an elbow is provided at the rear of the housing.

8. The central vacuum cleaning system according to claim 7, wherein a swivel switch is provided at the swivel connecting portion and is connected to an electric wire leading from the air intake box with the switch member of the filter carrier.

9. The central vacuum cleaning system according to claim 1, wherein a hook is provided at the housing of the filter carrier for holding a rolled up intake hose when not in use.

10. The central vacuum cleaning system according to claim 1, wherein a flap valve is provided at the inlet of the filter carrier for preventing the dust caught in the filter from overflowing.

* * * * *

UNITED STATES PATENT AND TRADEMARK OFFICE

CERTIFICATE OF CORRECTION

PATENT NO. : 6,516,492 B1
APPLICATION NO. : 09/744311
DATED : February 11, 2003
INVENTOR(S) : Heung-Mook Kang It is certified that error appears in the above-identified patent and that said Letters Patent is hereby corrected as shown below:

At item (73) of the cover sheet:

please delete "Nam & Nam, Seoul (KR)"

Signed and Sealed this

Thirty-first Day of August, 2010

David J. Kappos

David J. Kappos
*Director of the United States Patent and Trademark Office*